US007476120B2

(12) United States Patent
Patel et al.

(10) Patent No.: US 7,476,120 B2
(45) Date of Patent: Jan. 13, 2009

(54) WIRE CONTAINMENT CAP WITH AN INTEGRAL STRAIN RELIEF CLIP

(75) Inventors: Satish I. Patel, Roselle, IL (US); Paul B. Ducharme, New Lenox, IL (US); Robert Fritz, Elwood, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 11/305,476

(22) Filed: Dec. 16, 2005

(65) Prior Publication Data

US 2006/0148302 A1 Jul. 6, 2006

Related U.S. Application Data

(60) Provisional application No. 60/636,972, filed on Dec. 17, 2004.

(51) Int. Cl.
*H01R 13/58* (2006.01)

(52) U.S. Cl. ..... 439/460; 439/472

(58) Field of Classification Search ..... 439/460, 439/469, 472

See application file for complete search history.

(56) References Cited

U.S. PATENT DOCUMENTS 4,516,822 A 5/1985 Wolfel
4,975,078 A * 12/1990 Stroede et al. ..... 439/405
5,445,538 A * 8/1995 Rodrigues et al. ..... 439/460
5,514,007 A * 5/1996 Rodrigues ..... 439/469
5,653,609 A * 8/1997 Orstad et al. ..... 439/472
6,109,954 A * 8/2000 Lin ..... 439/460
6,953,362 B2 * 10/2005 Mossner et al. ..... 439/395

FOREIGN PATENT DOCUMENTS

| | | |
|---|---|---|
| EP | 0 653 811 A1 | 5/1995 |
| EP | 1 251 601 A1 | 10/2002 |
| EP | 1 257 011 A2 | 11/2002 |
| GB | 2 183 405 A | 6/1987 |
| WO | WO 96/08855 | 3/1996 |

* cited by examiner

*Primary Examiner*—Thanh-Tam T Le
(74) *Attorney, Agent, or Firm*—Robert A. McCann; Zachary J. Smolinski; Christopher K. Marlow

(57) ABSTRACT

A wire containment cap for reducing horizontal strain on a cable terminated at a communication jack. The wire containment cap is part of the communication jack and includes a strain relief clip that may be actuated to apply pressure to the cable. The applied pressure holds the cable in place and helps prevent wire pairs of the cable from pulling out of terminals in the communication jack.

25 Claims, 8 Drawing Sheets

(See FIG. 6)

(See FIG. 6)

WIRE CONTAINMENT CAP WITH AN INTEGRAL STRAIN RELIEF CLIP

CROSS-REFERENCE TO RELATED APPLICATION

This application claims the benefit of U.S. Provisional Application No. 60/636,972, filed Dec. 17, 2004 and entitled "Wire Containment Cap With An Integral Strain Relief Clip," the entirety of which is incorporated herein by reference.

FIELD OF THE INVENTION

The present invention relates generally to electrical connectors, and more particularly, to an improved wire containment cap for a modular communication jack design.

BACKGROUND OF THE INVENTION

A structured cabling system is a complete system of cabling and associated hardware, which provides a comprehensive telecommunications infrastructure. This infrastructure serves a wide range of uses, such as to provide telephone service or transmit data through a computer network. The structured cabling system may consist of horizontal cable, cabling connectors, and patch cords, among other things. Horizontal cable is typically routed in the ceiling, under the floor, or in the walls. In a typical application, one end of a horizontal cable run may be located in a telecommunications closet and the other end of the horizontal cable run may be located at an outlet. The telecommunications closet may be a room where telecommunications equipment, such as a hub or a switch, is located. The outlet may be a location where telecommunications equipment, such as a computer or a printer, may eventually be placed. Each end of the horizontal cable run may then be terminated to a cabling connector such as a modular jack. The modular jack is used to interface the horizontal cable with a patch cord and provides flexibility in the network. Once the horizontal cable is properly terminated, the modular jack is typically mounted in a faceplate or a patch panel. A patch cord may then be used to connect the mounted modular jack to telecommunications equipment.

During the installation of a structured cabling system, strain may be applied to horizontal cable runs that are terminated to mounted modular jacks. One cause of strain on a horizontal cable run may be a technician pulling new horizontal cable runs in close proximity to the existing horizontal cable runs. Another cause of strain on a horizontal cable run may be a technician placing existing horizontal cable runs routed in similar locations into cable bundles. These cable bundles may increase the strain applied to each individual horizontal cable run. Yet another cause of strain on a horizontal cable run may be a technician installing a horizontal cable run with insufficient slack. The horizontal cable run may then need to be pulled taut to reach the mounting location of the modular jacks and this may introduce a constant strain onto the horizontal cable run.

Strain may also be applied to horizontal cable runs that are terminated to mounted modular jacks after the structured cabling system has been installed. A major cause of this strain on a horizontal cable run may be a network administrator rearranging the location of particular modular jacks or cables in the structured cabling system. After removing a modular jack from its mounted position, the network administrator may apply strain on the horizontal cable run by pulling the modular jack and the terminated horizontal cable run to its new location. The network administrator may also place the modular jack in a new mounting location where the terminated horizontal cable run does not have sufficient slack, which may introduce a constant strain onto the horizontal cable run.

Applying strain to a terminated horizontal cable run may introduce problems in the termination area of a modular jack. One problem with applying strain to a horizontal cable run is that the wire pairs of the cable may be partially or fully pulled out of the insulation displacement contact ("IDC") terminals of the modular jack, which may result in wirecap failures or variability in modular jack performance. Another problem with applying strain to a horizontal cable run is that the strain may damage the IDC terminals of the modular jack. Yet another problem with applying strain to a horizontal cable run, and particularly constant strain, is that over time the strain may cause the horizontal cable insulation near the termination area of the modular jack to pull back, rip or tear apart and expose live wire pairs. Any exposure of live wire pairs may present a safety hazard, result in a short circuit, or change the electrical performance of the modular jack. Accordingly, a solution that addresses the problems that strain introduces at the termination area of the modular jack would be desirable.

DETAILED DESCRIPTION OF THE PREFERRED EMBODIMENTS

Figure 1:
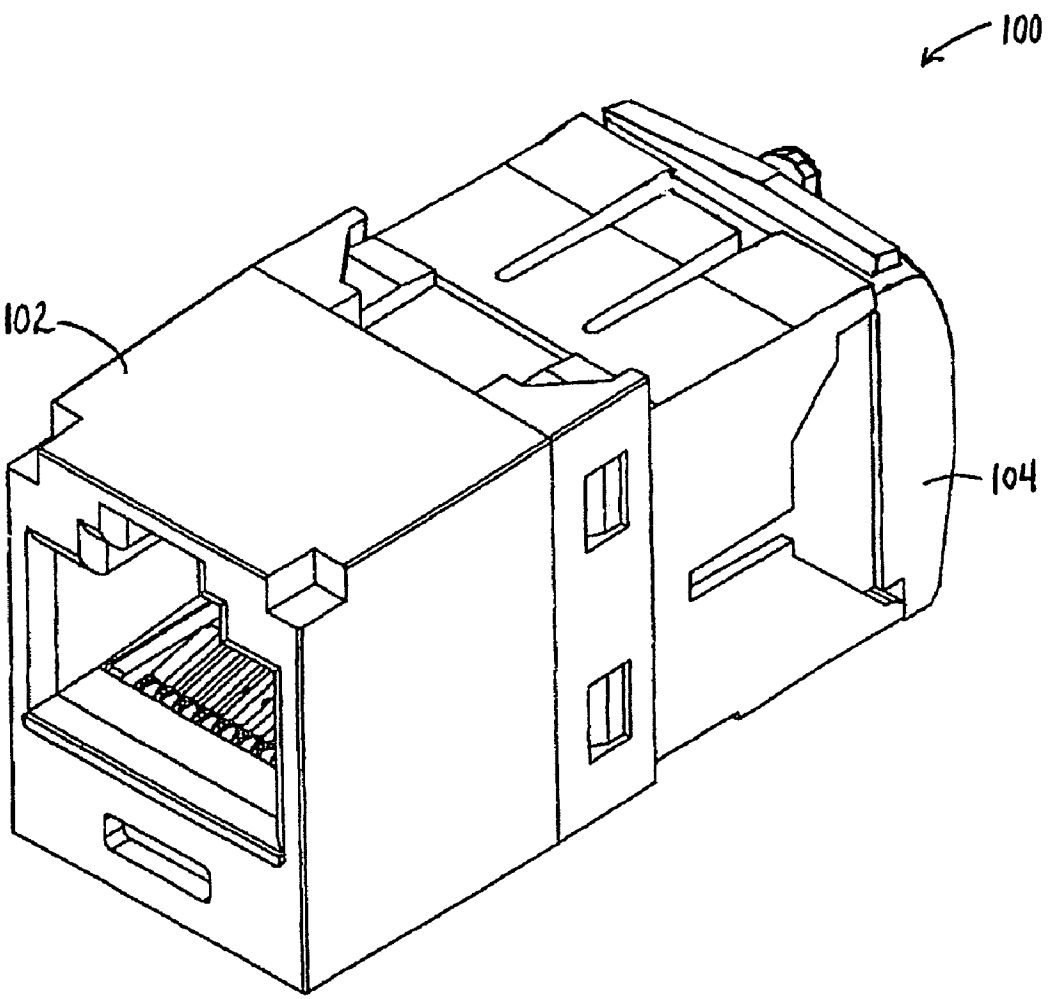
FIG. 1 is a front upper right perspective view of a communication jack having a wire containment cap in accordance with an embodiment of the present invention.

FIG. 1 is a front upper right perspective view of a communication jack 100 in accordance with an embodiment of the present invention. The communication jack 100 includes a jack housing 102 and a wire containment cap 104. The jack housing 102 may include such components as plug interface contacts, a mechanism for coupling the jack to a plug, crosstalk compensation circuitry, and wire-displacement contacts to provide an electrical connection between the jack and a communication cable. Additional details on the wire containment cap 104 are described with reference to FIGS. 3 and 5 below.

Figure 2:
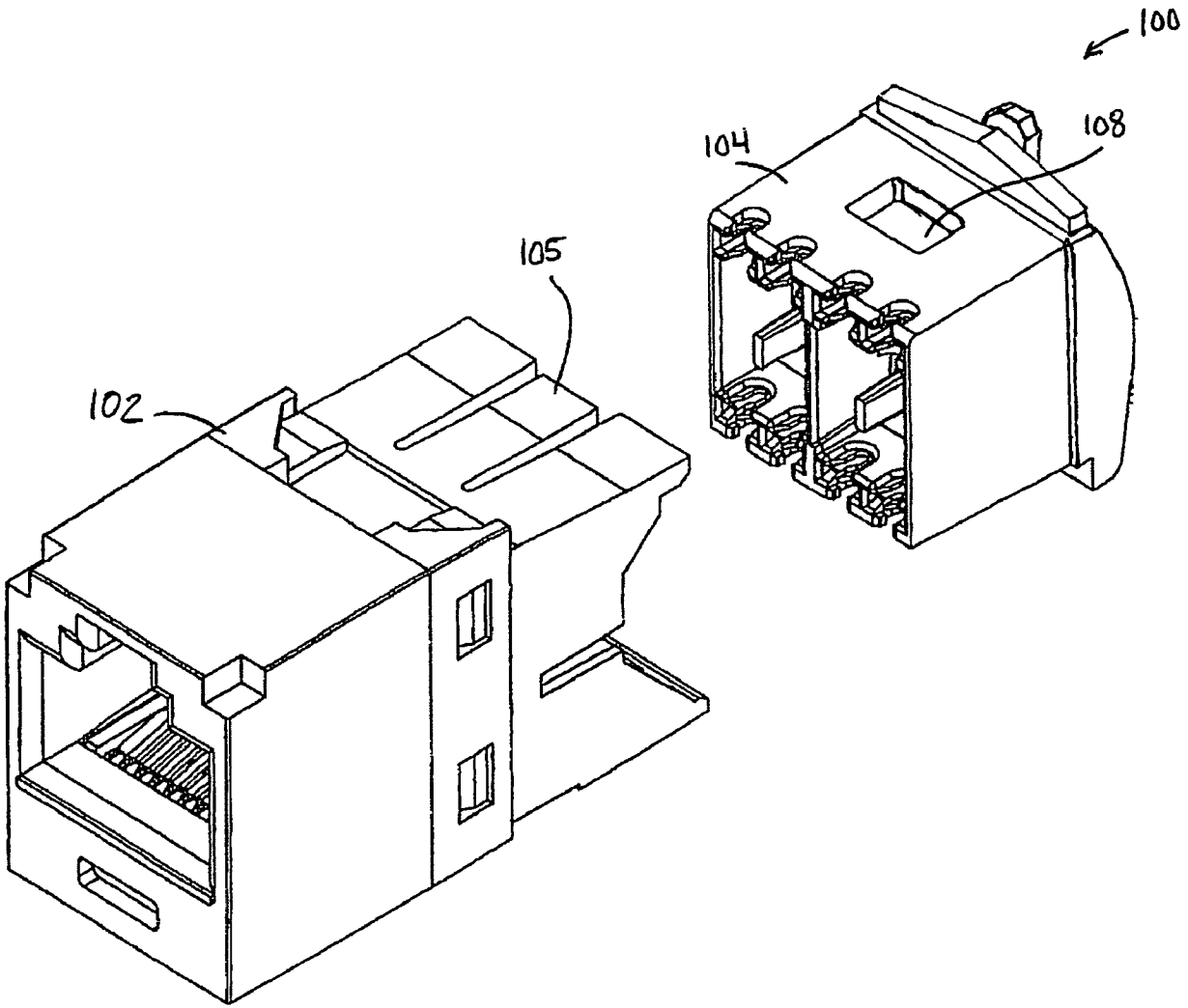
FIG. 2 is a front upper right partial-exploded view of the communication jack of FIG. 1.

FIG. 2 is a front upper right partial-exploded view of the communication jack 100 of FIG. 1. In the embodiment shown, the wire containment cap 104 is slidably mountable within the jack housing 102. A retention clip 105 on the jack housing 102 and a retention recess 108 on the wire containment cap 104 may be included to secure the wire containment cap 104 to the jack housing 102. Other mounting and securing techniques may also be used.

Figure 3:
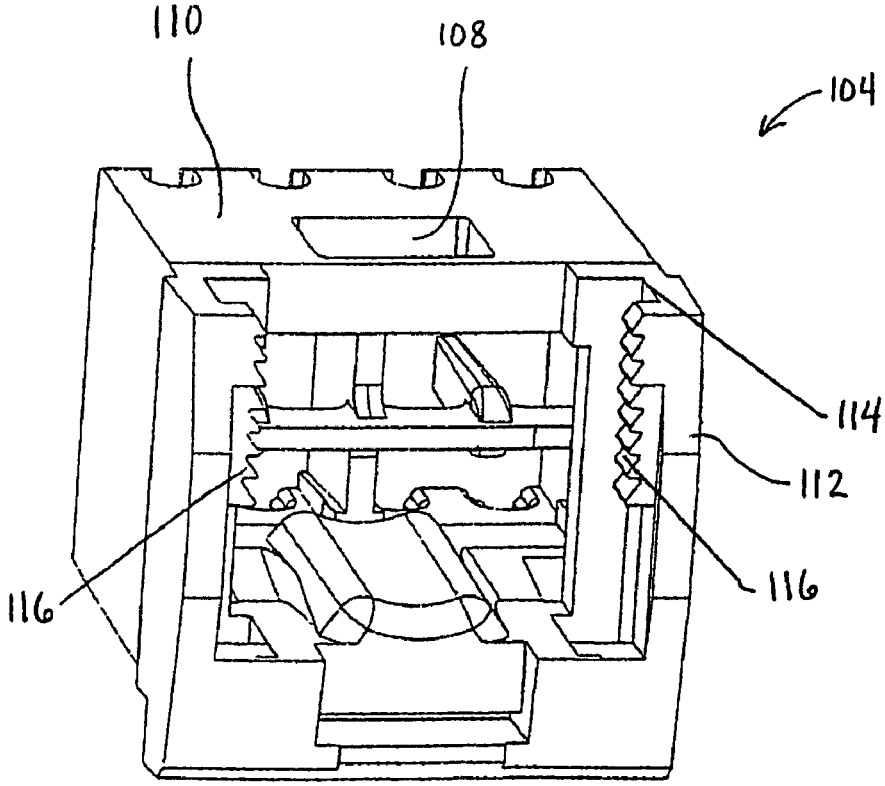
FIG. 3 is a rear upper left perspective view of the wire containment cap of FIGS. 1 and 2.

FIG. 3 is a rear upper left perspective view of the wire containment cap 104 of FIGS. 1 and 2. In addition to the retention recess 108 described above with reference to FIG. 2, the wire containment cap 104 may include a wire cap divider 110, a shoulder 112, two strain relief guide slots 114, and two sets of latch teeth 116. In a preferred embodiment, the wire containment cap 104 is constructed of a plastic material, such as polycarbonate. Alternative materials, shapes, and subcomponents could be utilized instead of what is illustrated in FIG. 3.

The wire cap divider 110 may include a spine, pair separators, a support rib, upper wire restraints, and lower wire restraints.

The shoulder 112 may serve as a support and stopping mechanism to place the wire containment cap 104 in a correct physical position with respect to the jack housing 102 shown in FIGS. 1 and 2. Alternative support and/or stopping mechanisms could also be used, such as one located on the jack housing 102, or on the wire containment cap 104 in such a position that it abuts an interior location in the jack housing 102, rather than the exterior abutment shown in FIGS. 1 and 2.

The strain relief guide slots 114 may serve as a support mechanism to place a strain relief clip 200 in a correct physical position with respect to the wire containment cap 104 and a cable. The strain relief guide slots 114 may be hollow channels molded into each side of the shoulder 112. The strain relief guide slots 114 may be located where the shoulder 112 is connected to the rear portion of the wire cap divider 110. The strain relief guide slots 114 may have an opening on the top side of the shoulder 112. The dimensions of the strain relief guide slots 114 may be designed to match the dimensions of the strain relief clip 200. Alternative methods for supporting the strain relief clip 200 in the wire containment cap 104 may also be used. Additional details on the strain relief clip 200 are described with reference to FIG. 4 below.

The latch teeth 116 may serve to lock the strain relief clip 200 into place. The latch teeth 116 may border the strain relief guide slots 114. In the illustrated embodiment, the latch teeth 116 are positioned on the opposite side of the wire cap divider 110. In an alternative embodiment, the latch teeth could be positioned on the same side as the wire cap divider 110. The latch teeth 116 may be separate components molded to the rear inner edge of the shoulder 112 and two sets of latch teeth 116 may be used, one on each side. Alternatively, the latch teeth 116 may be molded as an integrated part of the shoulder 112. Additional details on the latch teeth 116 are described with reference to FIG. 5 below. Alternative methods for locking the strain relief clip 200 into the wire containment cap 104 may also be used.

Figure 4:
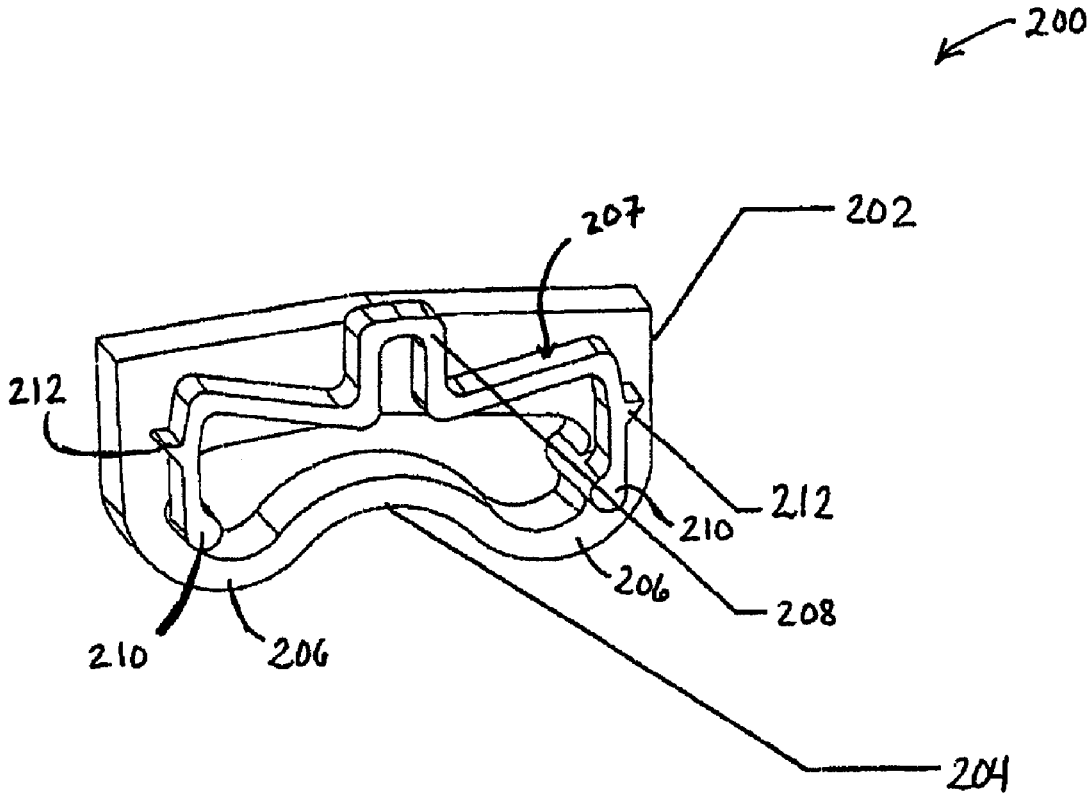
FIG. 4 is a rear upper left perspective view of a strain relief clip in accordance with an embodiment of the present invention.

FIG. 4 is a rear upper left perspective view of the strain relief clip 200. The strain relief clip 200 may include a strain relief base 202 with an arch 204 and two curved sections 206. The strain relief clip 200 also includes a latch release section 207 on the strain relief base 202. The latch release section 207 has a latch release 208, two latch release pivot points 210, and two clip latches 212. In a preferred embodiment, the strain relief clip 200 is constructed of a plastic material, such as polycarbonate. The strain relief clip 200 may be supplied as partially assembled to the wire containment cap 104. Alternatively, the strain relief clip 200 may be molded together with the wire containment cap 104 at the top of the strain relief guide slots 114. In this embodiment, the plastic connecting the strain relief clip 200 to the wire containment cap 104 may be broken off by a technician during field termination. Alternative materials, shapes, and subcomponents of the strain relief clip 200 could be utilized instead of what is illustrated in FIG. 4.

The strain relief base 202 may serve as the part of the strain relief clip 200 that secures a cable 300 to the wire containment cap 104. The strain relief base 202 may slide into the strain relief guide slots 114. The arch 204 is a section at the bottom of the strain relief base 202 that curves inward towards the center of the strain relief base 202. The strain relief base 202 may have an open center to allow the arch 204 to flex upwards when the strain relief base 202 begins to compress the cable 300. The arch 204 may have an inner radius approximating that of the cable to be secured (e.g. 0.190" to 0.250") and a thickness sufficient to allow some flexibility without consistently breaking under normal operating conditions. The curved sections 206 may be located on either side of the arch 204 at the bottom of the strain relief base 202. The curved sections 206 have a radius that may change as upward pressure is placed on the arch 204. The strain relief base 202 may accommodate a range of twisted pair cable diameters. Typically, cables with a diameter ranging from 0.190" to 0.250" may fit into the arch 204 of the strain relief base 202. Additional details on the strain relief base 202 are described with reference to FIG. 5 below.

The latch release 208 may serve as a lever to disengage the strain relief clip 200 from the wire containment cap 104.The latch release 208 may be connected to the strain relief base 202 at two latch release pivot points 210. The latch release 208 may border the rear side of the strain relief base 202. Alternative shapes of the latch release 208 could be utilized instead of what is illustrated in FIG. 4. Additional details on the latch release 208 are described with reference to FIG. 5 below.

The clip latches 212 may serve to engage the strain relief clip 200 to the wire containment cap 104. The clip latches 212 may be separate components molded to the outer edge of the latch release 208 and two clip latches may be used, one on each side. Alternatively, the clip latches 212 may be molded as an integrated part of the latch release 208. The clip latches 212 may be formed to fit into the latch teeth 116. Additional details on the clip latches 212 are described with reference to FIG. 5 below. Alternative methods for engaging the strain relief clip 200 to the wire containment cap 104 may also be used.

Figure 5:
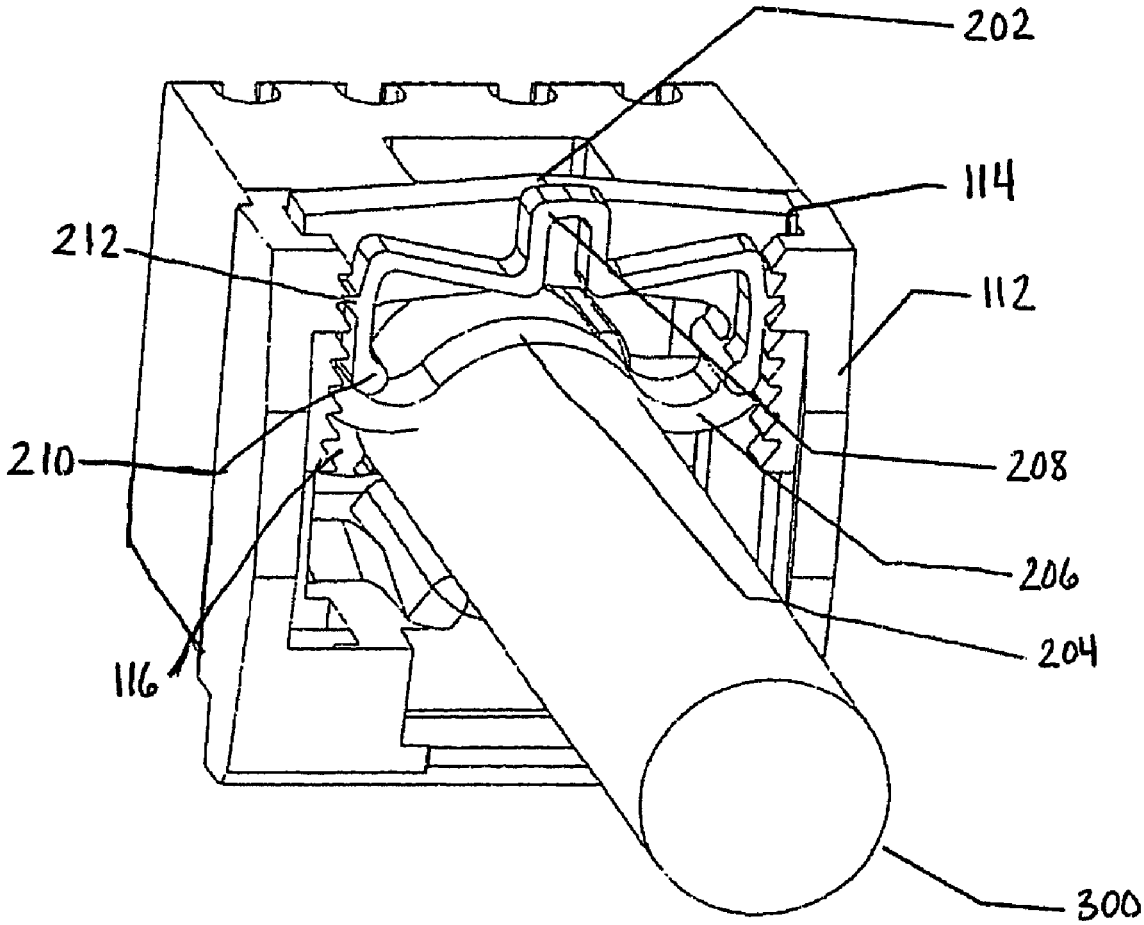
FIG. 5 is a rear upper left perspective view of the strain relief clip of FIG. 4 assembled to the wire containment cap of FIGS. 1-3 and securing a cable.
Figure 6:
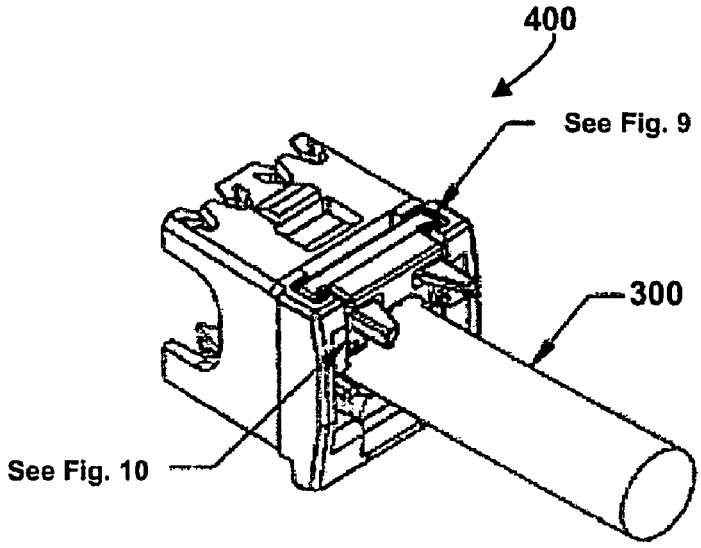
FIG. 6 is a rear upper left perspective view of an alternative strain relief clip and wire containment cap securing a cable.
Figure 7:
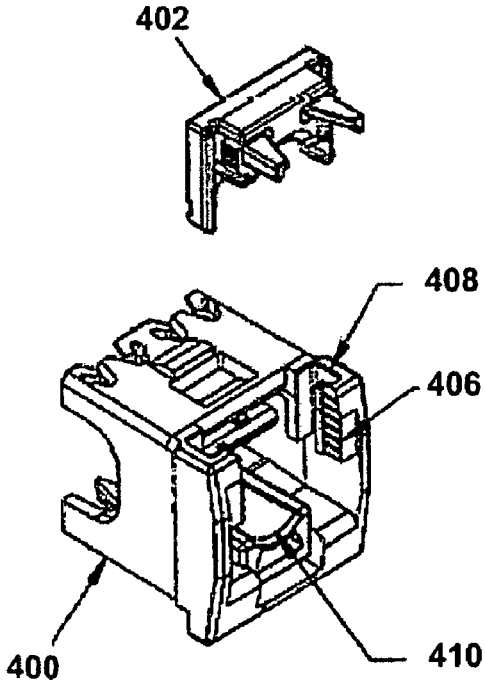
FIG. 7 is a rear upper left perspective view of an alternative strain relief clip and wire containment cap.
Figure 8:
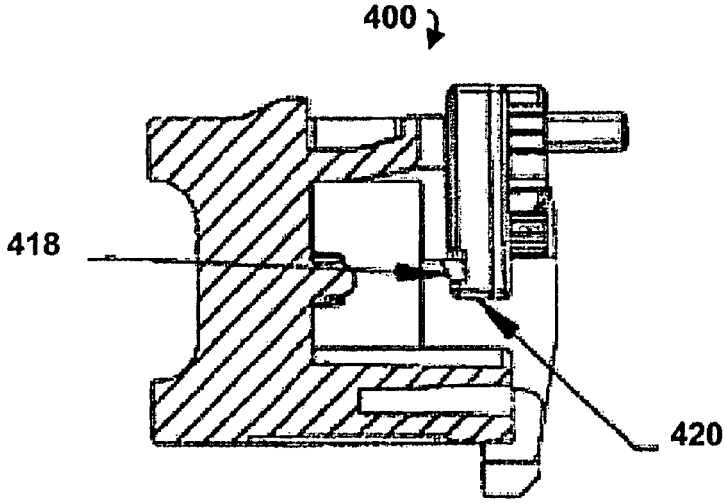
FIG. 8 is a side cross-sectional view of an alternative strain relief clip and wire containment cap.

FIG. 5 is a rear upper left perspective view of the strain relief clip 200 assembled to the wire containment cap 104 and securing a cable 300. The strain relief base 202 may be inserted into the strain relief guide slots 114 by pressing down on the top edge of the strain relief base 202. As the strain relief base 202 is pressed further into the strain relief guide slots 114, the clip latches 212 may ratchet against the latch teeth 116. Once the strain relief base 202 reaches the cable 300, the arch 204 of the strain relief base 202 may then begin to compress the cable 300 and upward pressure from the cable 300 may push the arch 204 higher. As the cable 300 pushes the arch 204 higher, a pull may be created that changes the radius of the curved sections 206. The change in radius of the curved sections 206 may then result in an outward rotation in the latch release pivot points 210. This rotation in the latch release pivot points 210 may cause the clip latches 212 to rotate and dig deeper into the latch teeth 116, creating a preload and locking the strain relief clip 200 into place. If further compression of the cable 300 is desired, the strain relief base 202 may then be pressed further into the strain relief guide slots 114.

The strain relief clip 200 may also be removed from the wire containment cap 104 after assembly by pressing the latch release 208 downward toward the cable 300. The downward pressure on the latch release 208 may cause the clip latches 212 to pull inward and disengage from the latch teeth 116. While holding the latch release 208 down, the cable 300 may then be lifted up to relieve the pressure. The strain relief clip 200 may then be removed entirely from the wire containment cap 104 if desired.

FIGS. 6-11 illustrate an alternative wire containment cap 400 and an alternative strain relief clip 402 for use with the alternative wire containment cap 400 to secure a cable 300.

Figure 9:
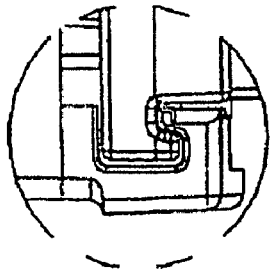
FIG. 9 is a close-up diagram of a portion of FIG. 6.
Figure 10:
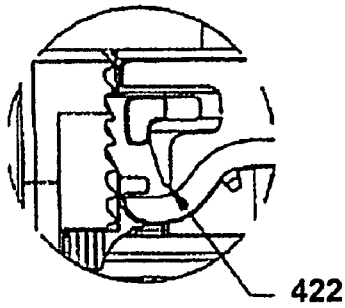
FIG. 10 is a close-up diagram of a portion of FIG. 6.
Figure 11:
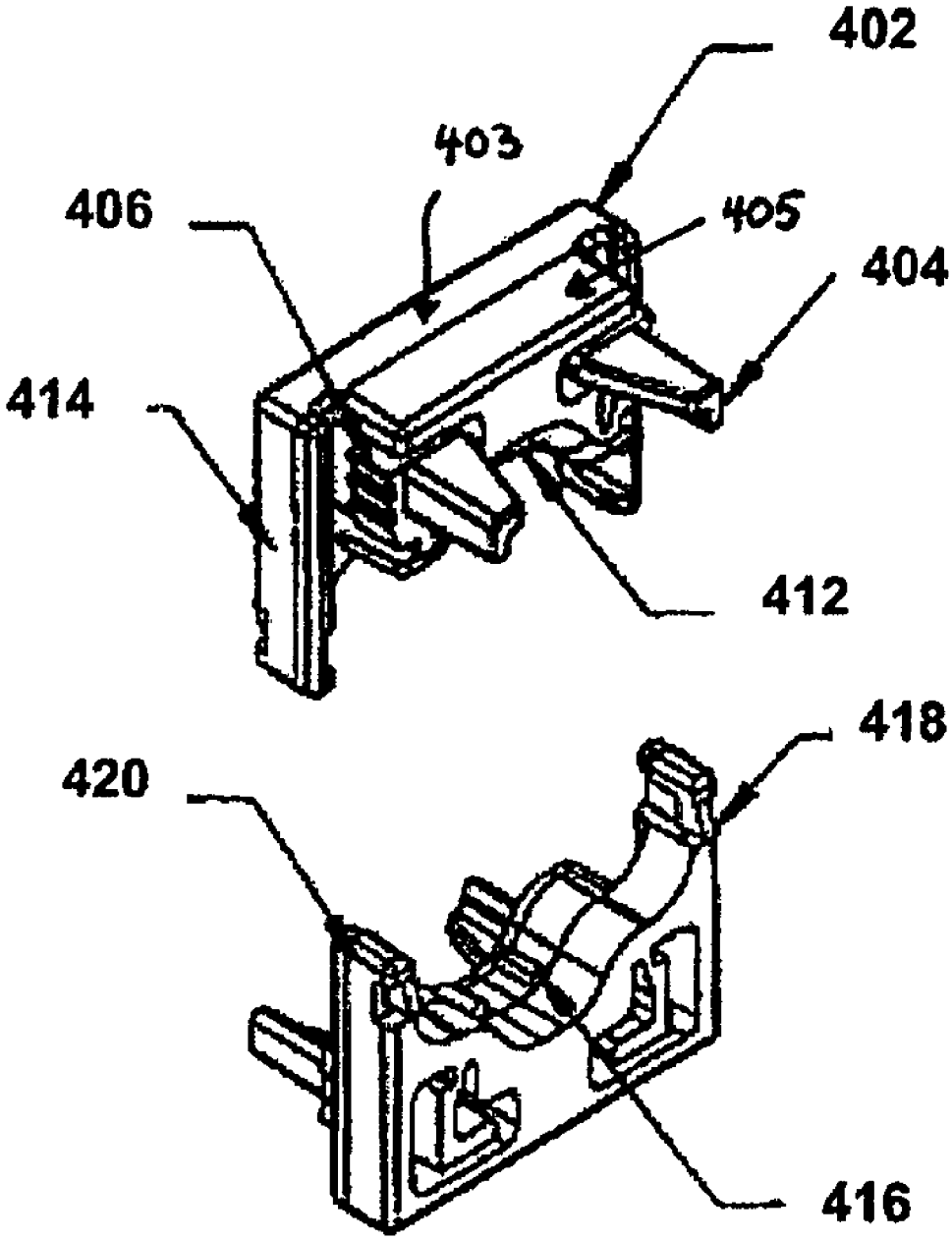
FIG. 11 shows two perspective views of an alternative strain relief clip.

Wire containment cap 400 is similar to the wire containment cap 104 described in FIGS. 1-5, but includes some different features. In addition to guide slots 408 and cable saddle 410, the wire containment cap 400 is configured to interface with the alternative strain relief clip 402 more intimately, as shown in FIGS. 9 and 10.

The strain relief clip 402 is similar to the strain relief clip 200 described in FIGS. 1-5, but includes some different features. The strain relief clip 402 has a strain release base 403 and a latch release section 405 on the strain relief base 403. The latch release section 405 contains latch release tabs 404 and latch teeth 406. In addition to latch release tabs 404 and latch teeth 406, the strain relief clip 402 includes cable jacket retention teeth 416, a strain relief top stop 418, a strain relief bottom stop 420, a channel post 414, a latch teeth hinge area 422, and a cable clamp slot 412.

The latch release tabs 404 may be depressed together to allow a technician to easily move the strain relief clip 402 up in the guide slots 408. Once inserted into the wire containment cap 400, the strain relief clip is not easily removed (due to the strain relief top stop 418), resulting in improved retention of cable 300. Each channel post 414 is slidably secured in respective guide slot 408 to provide guidance and retention of the strain relief clip 402.

The cable 300 is centered and held in place by the cable saddle 410 and the cable clamp slot 412. In a shielded version of the wire containment cap 400, the strain relief clip 402 could include flanges to contact the jacket (not shown) of the cable 300 on installation, thereby preventing the more rigid shielded cable from pulling out or moving within the wire containment cap 400.

The cable jacket retention teeth 416 help secure the cable 300 to the communication jack (not shown) comprising the wire containment cap 400.

For either of the embodiments disclosed herein, in a typical installation, a technician may first remove approximately 1" of the cable 300 jacket and cut the excess divider if present. The technician may then separately route each twisted wire pair (blue, green, orange, and brown) through its respective quadrant pair channel of the wire cap divider 110 and push the cable 300 into the rear of the wire containment cap 104 until the edge of the cable 300 jacket reaches the wire cap divider 110. Next, the technician may insert the strain relief clip 200 into the wire containment cap 104 and push downward until sufficient compression of the cable is achieved. This may secure the cable 300 to the wire containment cap 104. Finally, the technician may route each conductor into the proper wire restraint slot and cut the conductors so that they are flush with the top and/or bottom face of the wire containment cap 104.

Securing the cable 300 to the wire containment cap 104 with the strain relief clip 200 may provide many benefits. First, securing the cable 300 prior to routing the conductors to the wire restraint slots may simplify conductor separation and seating because the cable 300 may no longer move during this process. Additionally, securing the cable 300 to the wire containment cap 104 may prevent the wire pairs of the cable 300 from being pulled out of the insulated IDC terminals of the communication jack 100. Furthermore, securing the cable 300 to the wire containment cap 104 may prevent the cable 300 jacket from pulling back, ripping or tearing apart. Therefore, securing the cable 300 to the wire containment cap 104 with the strain relief clip 200 may provide additional stability in the termination area of the communication jack 100 and may also improve electrical performance.

What is claimed:

1. A wire containment cap for a communication jack, the wire containment cap comprising:

a strain relief clip configured to apply pressure against a cable inserted in the wire containment cap; and a shoulder containing strain relief guide slots in which the strain relief clip is disposed, the strain relief clip secured in the strain relief guide slots by latch teeth, the strain relief clip including a base that slides within the strain relief guide slots in a direction perpendicular to an insertion direction of the cable, the base comprising first and second faces, the base positioned in the guide slots such that the first face faces towards a center of the wire containment cap and the second face faces away from the center of the wire containment cap, the guide slots engaging a portion of the base on the first face and a portion of the base on the second face, and a latch release section more distal than the base from an end of the wire containment cap into which the cable is inserted wherein each strain relief guide slot comprises two opposite sidewalls, the latch teeth being located on one of the two opposite sidewalls; and wherein the strain relief clip contains at least one clip latch that is molded to an outer edge of the latch release and engages with the latch teeth of the shoulder.

2. The wire containment cap of claim 1, wherein the strain relief clip is removable from the wire containment cap, thereby facilitating insertion of the cable in the wire containment cap.

3. The wire containment cap of claim 1, wherein the cable is inserted horizontally in the wire containment cap and wherein the strain relief clip is inserted vertically in the wire containment cap to apply an adjustable pressure against the cable inserted in the wire containment cap.

4. The wire containment cap of claim 1, wherein the strain relief clip may be ratcheted downward in the strain relief guide slots to apply greater pressure to the cable inserted in the wire containment cap.

5. The wire containment cap of claim 4, wherein the strain relief clip may be unsecured from the strain relief guide slots by applying a force to a latch release of the latch release section.

6. The wire containment cap of claim 5, wherein the strain relief base has an arch to apply pressure to the cable and at least one curved section that changes in radius as the strain relief clip is pressed against the cable, the latch release section having at least one latch release pivot point and the at least one clip latch that interfaces with the latch teeth, and wherein the force applied to the latch release provides assistance in releasing the at least one clip latch from the latch teeth.

7. The wire containment cap of claim 6, wherein the arch has in inner radius approximating that of the cable.

8. The wire containment cap of claim 1, wherein the strain relief clip is partially assembled to the wire containment cap.

9. The wire containment cap of claim 1, wherein the strain relief clip is molded together with the wire containment cap at the top of the strain relief guide slots.

10. The wire containment cap of claim 1, wherein the strain relief clip comprises at least one cable jacket retention tooth.

11. The wire containment cap of claim 1, further comprising a cable saddle that, along with the strain relief clip, secures the cable in the wire containment cap.

12. The wire containment cap of claim 1, wherein the strain relief clip may be released to remove pressure from the cable by activating latch release tabs, the latch release tabs extending substantially in a direction of insertion of the cable into the wire containment cap.

13. The wire containment cap of claim 1, wherein the strain relief clip is disposed in the each guide slot such that the strain relief clip is sandwiched between the two opposite sidewalls of the each guide slot in a direction substantially perpendicular to the direction of insertion of the cable.

14. The wire containment cap of claim 13, wherein the latch teeth are located on opposite sides of the shoulder and face each other.

15. The wire containment cap of claim 1, wherein the strain relief clip has a substantially "T"-shaped cross-section when viewed from a direction substantially perpendicular to a direction of insertion of the cable and the guide slots each have a substantially "L"-shaped cross-section when viewed from the direction substantially perpendicular to the direction of insertion of the cable.

16. The wire containment cap of claim 1, wherein the strain relief guide slots have an opening on only one side of the shoulder.

17. A communication jack for terminating a cable, the communication jack having a wire containment cap through which the cable is inserted to make electrical contact with terminals in the communication jack, the wire containment cap comprising:

a retention recess for accepting a retention clip when the wire containment cap is slidably mounted on the communication jack;

at least one opening though which the cable may be inserted;

a strain relief clip that may be slidably moved in the wire containment cap to apply pressure to the cable to physically secure the cable in the wire containment cap, thereby reducing strain along an axis of the cable defined by the direction in which the cable is inserted in the wire containment cap; and a shoulder containing strain relief guide slots in which the strain relief clip is slidably movable in a direction perpendicular to an insertion direction of the cable and restrained from movement in a direction parallel to the insertion direction of the cable, the strain relief clip secured in the strain relief guide slots by latch teeth on the shoulder, the strain relief clip including a base that slides within the strain relief guide slots and a latch release section integral with the base and more distal from the retention recess than the base;

wherein each strain relief guide slot comprises two opposite sidewalls, the latch teeth being located on one of the two opposite sidewalls; and wherein the strain relief clip contains at least one clip latch that is molded to an outer edge of the latch release and engages with the latch teeth of the shoulder.

18. The communication jack of claim 17, wherein the strain relief clip may be temporarily secured to the wire containment cap to maintain pressure against the cable inserted in the wire containment cap.

19. The wire containment cap of claim 17, wherein the strain relief clip may be released to remove pressure from the cable by activating latch release tabs, the latch release tabs extending substantially in the direction of insertion of the cable into the wire containment cap.

20. A wire containment cap for securing a cable to a communication jack, the wire containment cap comprising:

a strain relief clip that may be actuated to provide constant pressure against a cable inserted in the wire containment cap, the strain relief clip having latch release tabs that extend away from a center of the strain relief clip substantially in a direction of removal of the cable from the wire containment cap, the strain relief clip releasable by activating the latch release tabs; and a shoulder containing strain relief guide slots in which the strain relief clip is disposed, the strain relief clip slidable in the strain relief guide slots in a direction perpendicular to an insertion direction of the cable, and restrained from movement in a direction parallel to the insertion direction of the cable;

wherein the strain relief clip is secured within the strain relief guide slots by latch teeth, the strain relief clip including a base that slides within the strain relief guide slots and a latch release section more distal than the base from an end of the wire containment cap into which the cable is inserted;

wherein each strain relief guide slot comprises two opposite sidewalls, the latch teeth being located on one of the two opposite sidewalls; and wherein the strain relief clip contains at least one clip latch that is molded to an outer edge of the latch release and engages with the latch teeth of the shoulder.

21. The wire containment cap of claim 20, wherein the strain relief clip may be actuated by moving the strain relief clip toward the cable at predefined increments, thereby incrementally increasing pressure applied against the cable inserted in the wire containment cap.

22. The wire containment cap of claim 20, wherein the strain relief clip comprises at least one cable jacket retention tooth.

23. The wire containment cap of claim 20, wherein the strain relief clip is disposed in the each guide slot such that the strain relief clip is sandwiched between the two opposite sidewalls of the each guide slot in a direction substantially perpendicular to the direction of insertion of the cable.

24. The wire containment cap of claim 20, wherein the strain relief clip has a substantially "T"-shaped cross-section when viewed from a direction substantially perpendicular to the direction of insertion of the cable and the guide slots each have a substantially "L"-shaped cross-section when viewed from the direction substantially perpendicular to the direction of insertion of the cable.

25. The wire containment cap of claim 20, wherein the strain relief guide slots have an opening on only one side of the shoulder.

* * * * *